United States Patent [19]

Delcayre

[11] 4,030,731

[45] June 21, 1977

[54] ELECTRONIC EQUIPMENT FOR RADIO CONTROL OF FENCING BOUTS

[75] Inventor: Guy Delcayre, La Fleche, France

[73] Assignee: Anvar Agence Nationale de Valorisation de la Recherche, Neuilly-sur-Seine, France

[22] Filed: Aug. 4, 1975

[21] Appl. No.: 601,290

[30] Foreign Application Priority Data

Aug. 2, 1974 France ..... 74.26859

[52] U.S. Cl. ..... 273/1 F; 272/98; 340/323 R

[51] Int. Cl.[2] ..... A63B 69/02

[58] Field of Search ..... 35/29 R; 273/1 E, 1 F, 273/1 ES; 272/98; 340/323 R

[56] References Cited

UNITED STATES PATENTS

| | | | |
|---|---|---|---|
| 2,916,287 | 12/1959 | Davey | 273/1 F |
| 3,795,907 | 3/1974 | Edwards | 340/323 |
| 3,920,242 | 11/1975 | Reith et al. | 273/1 F |

FOREIGN PATENTS OR APPLICATIONS

| | | | |
|---|---|---|---|
| 81,004 | 6/1963 | France | 273/1 F |
| 53,004 | 12/1966 | Germany | 273/1 F |
| 234,905 | 10/1969 | U.S.S.R. | 273/1 F |

*Primary Examiner*—Richard C. Pinkham
*Assistant Examiner*—Vance Y. Hum
*Attorney, Agent, or Firm*—Darby & Darby

[57] ABSTRACT

Electronic equipment for scoring fencing bouts in which each fence is provided with a unit including a transmitter of a predetermined frequency and an aperiodic receiver. Each fencer's unit also includes a pulse generator whose pulses are used to distinguish valid touches, touches on the opposing weapon and the ground as well as touches on other conductive surfaces.

32 Claims, 6 Drawing Figures

ELECTRONIC EQUIPMENT FOR RADIO CONTROL OF FENCING BOUTS

Figure 1:
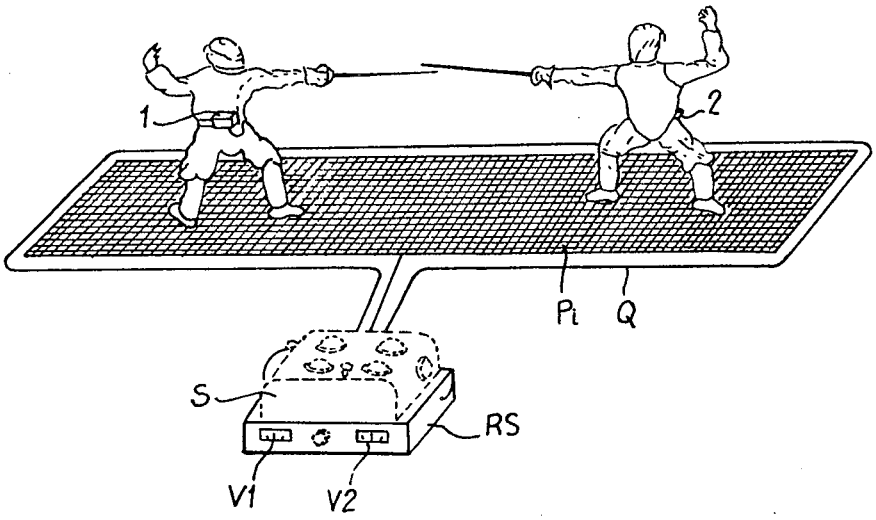

The invention relates to an electronic equipment for radio control of fencing bouts.

It is known, from French Pat. No. 1,162,554 and its first Certificate of Addition No. 78,556, that it is possible to produce equipment insuring the selection and transmission by electromagnetic waves of the touches occurring in the course of fencing matches, both with the epee and the foil or sabre, and thus permitting identification of the touches by the judges, in the form of visible or audible signals, without burdening the fencers with cables that are liable to hamper their movements.

Second Certificate of Addition, No. 81,004 to the said French Pat. No. 1,162,554, describes a composite equipment which is automatically adapted to the three weapons, and is capable of discriminating between touches on clothing and on a metal plastron, as well as inhibiting those made on the weapon of the other fencer and on the ground. With this in mind, a local command signal was provided, applied to the conductive zones to be differentiated (weapon, coat of mail or armor) and transmitted to the adverse weapon and to its touch selection circuit to actuate a remote signal, or, on the contrary, to prevent its tripping, according to the weapon used.

It has ben found in use, however, that in view of the procedure used the local signal applied to the electrical common of the touching weapon, could be picked up by coupling to its receiving tip, when the latter was in contact with a conductive area, even when not excited. This gave rise to erroneous indications for a touch on the mask or on clothing made conductive by perspiration. The same disturbances could also manifest themselves by diffusion of the adverse local signal toward the areas in question.

In addition, with weapons insuring both the transmission of the local signal to the adversary and the reception of his, the electronic circuits used were very complex, giving rise to a need for a system of compensation necessitating a large number of channels and tuned circuits. The very expensive and delicate apparatus was preadjusted to work as a composite unit. In the event of a breakdown of one of the two devices, the entire unit was unusable.

Moreover, since the transmission of electromagnetic signals between the fencers and the receivers of the judges, took place by means of antennas, the localization of the fields of radiation was not sufficient. The result was risks of influence between different groups of fencers, and a sensitivity to outside disturbances.

The signal applied to the ground was also in danger of being picked up by the receiving antennas placed nearby.

In the case of the foil and the sabre, the cancellation of touches on the weapons was not provided for.

It is the object of the invention to substantially simplify the devices, while insuring discrimination of the touches on the plastron, weapon and ground to permit, without special adjustments, interchangeability between similar devices, of one pair for another and to insure the elimination of residual signals picked up on the mask and damp clothing of the adversary. We also obtain elimination of the risks of interference by outside signals or parasitic disturbances, while avoiding the influence of the ground on the receiving system.

The invention has an object, electronic equipment for radio control of fencing bouts, of the type including for each fencer a transmitter of predetermined frequency, characterized in that it also includes, on each fencer, a pulse generator emitting signals of a particular form, polarity and length, and an aperiodic receiving set controlling the transmitter in such a way that the discrimination of the touches is determined according to the shape, polarity and length of the pulses received. Further, the electrical common point of the pulse generator carried by each fencer is connected to the body of the fencer, and the hot, or output signal lead, of the generator to the electrical common point of the weapon and the receiver, in such a way that the pluses from the generator will have no effect on the receiver, and the polarity of unwanted pulses will be reversed relative to that of the useful signals.

Figure 2:
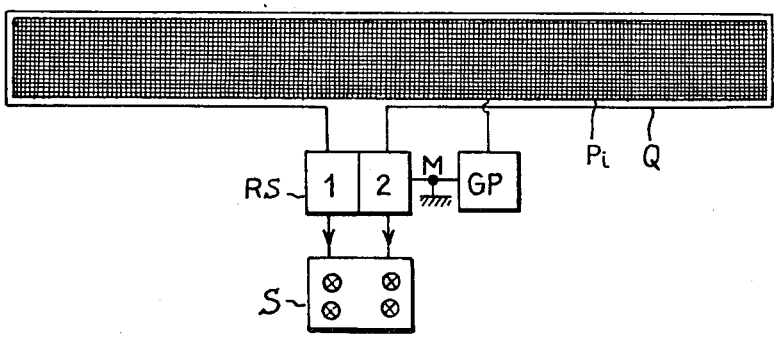
Figure 3:
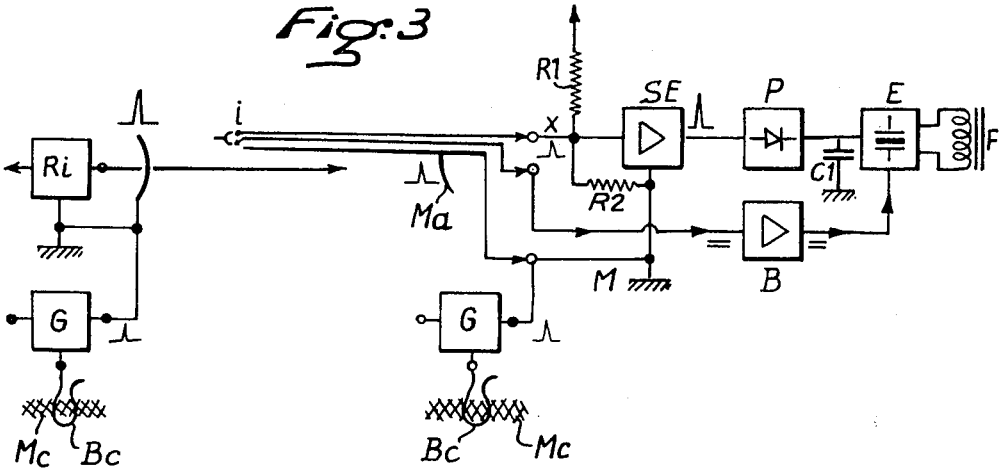
Figure 4:
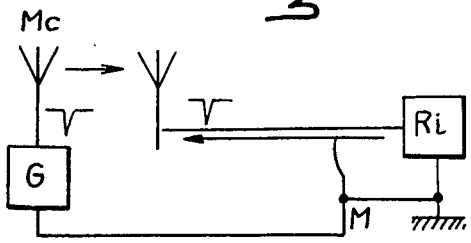
Figure 5:
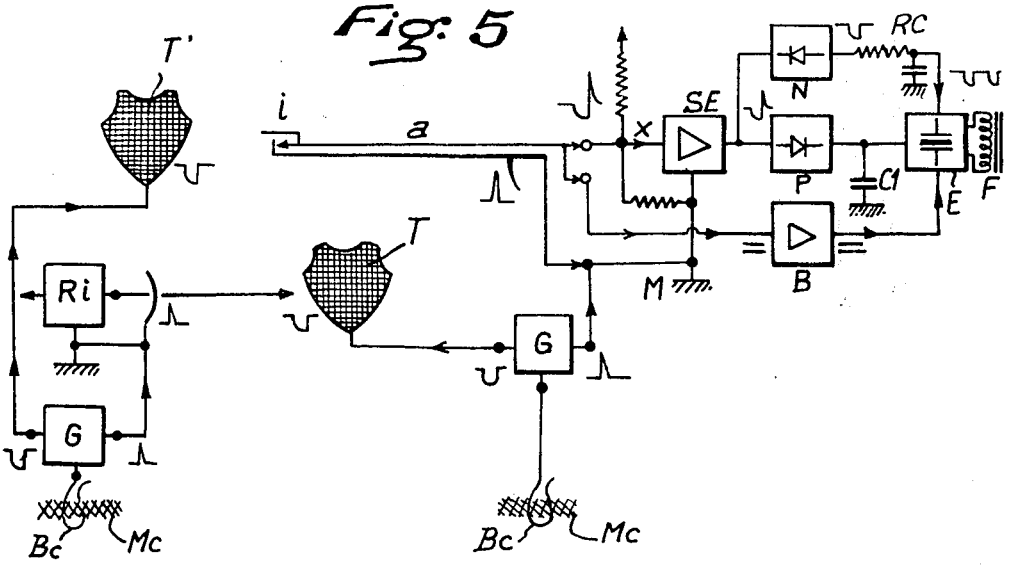

Other characteristics of the invention will appear on reading the description which follows, given in reference to the attached drawing in which we can see, in:

FIG. 1, a diagrammatic view of two fencers and a ground provided with the electronic control equipment according to the invention;

FIG. 2, a plan view of the fixed apparatus of FIG. 1, showing the various assemblies of which it is constituted;

FIG. 3, a schematic of the movable epee apparatus carried by the fencers;

FIG. 4, a view explaining the reception of a signal by coupling on a conductive area of the adversary;

FIG. 5, a schematic of the device as applied to the foil; and

Figure 6:
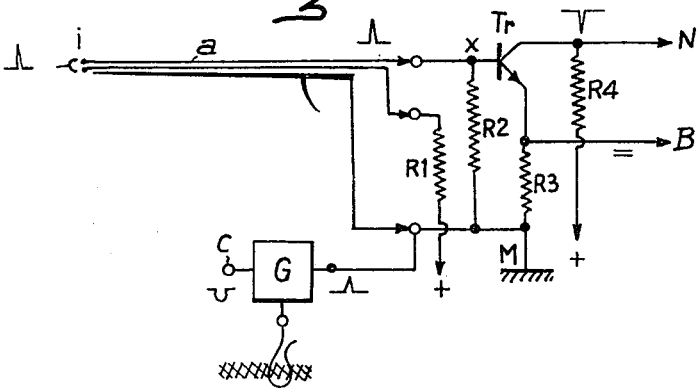

FIG. 6, a schematic of a buffer stage for the epee.

Referring to FIGS. 1 and 2, we see that each of the fencers carries a respective transmitting apparatus 1 and 2 acting remotely on a receiver RS connected to the usual signalling apparatus S, the latter being used by the judges. The conductive ground member P*i* of the fencing area is connected to a low-frequency pluse generator GP to neutralize strokes or touches, of the weapon to the floor. This is explained below.

Since the characteristics and the working frequency of the pulse generator GP, designed to excite the ground member P*i*, and those of the high-frequency remote-singalling receiver RS are very different, there can be no interference between the transmitting and receiving systems. The generator GP therefore can be incorporated in the receiver RS.

In FIG. 3, on the left, we see a schematic of a part of one of the individual apparatuses. We note that the latter has a pulse generator G connected between the electrical common (generally all or a part of the outer shell) of the weapon (illustrated by the arcuate line) and the body of the fencer M*c*, the latter by means of a metal bracelet B*c*. There is also an aperiodic receiver R*i* whose electrical common point is common to the electrical common point of the weapon. The complete general scheme is shown on the right in FIG. 3, which represents the second apparatus. Each fencer carries a complete apparatus embodying all of the componens of FIG. 3.

The transmitter E, characterized by a predetermined frequency for each apparatus, such as for example produced by a crystal controlled oscillator, transmits a continuous carrier signal (preferably in the radio frequency range) toward the signalling receiver RS of FIGS. 1 and 2, in such a way that a link is constantly established between each individual apparatus and the signalling receiver RS.

In order to identify each of the fencers present, the receiver RS has two separate channels 1 and 2, each characterized by a predetermined frequency corresponding to that of the individual apparatus concerned with a respective fencer.

The carrier signal received by each channel of the receiver RS 1 evaluated by a respective visual indicator V1 and V2 (FIG. 2) which makes it possible to verify the intensity thereof relative to a critical level. We thus have a continuous control to insure the proper operation of the entire system, and particularly of the state of the power supply batteries. As it happens, excessive wear of the batteries is shown by a detectable weakening of the received carrier signal. In case of accidental breakdown, the latter is automatically signalled by the continuous tripping of the signalling apparatus.

To avoid the influence of outside disturbances or of those caused by other installations developing on neighboring grounds, the signals emitted by the transmitter E of each individual apparatus carried by a fencer are localized with vertical directivity produced by a ferrite type loop antenna F. In addition, these signals are intercepted by a low impedance receiving loop Q surrounding the ground member P*i*, thereby limiting the area of effective operation of the device. The low-impedance loop Q is coupled to the two receiving channels of receiver RS by means of conventional suitable coupling systems.

Referring to FIG. 3, which illustrates the working of an individual apparatus for an epee, we see that in the interior of the blade, whose outer part M*a* is serving as the electrical common, two conductors are electrically connected to a conventional tip swtich I (a spring tip). One of the two conductors terminates at the input X to an amplifier stage SE with linear conductivity characteristics which acts as a buffer stage between the weapon and the following stage P. The latter is a device 1 with non-linear conductivity, for example a diode and other suitable components which passes only pulses of a predetermined polarity (positive in the example described) and short length. Resistors R1 and R2 insure correct bias at the input X of the buffer stage SE, while non-linear conductivity device P, is connected to the transmitter E of predetermined frequency by a capacitor C1 serving as integrator.

The other conductor provided in the weapon is used to apply the voltage present at the input X to SE to a current amplifier B, when a touch is made (closing of trip switch I). In this case, the current amplifier B operates to block the operation of transmitter E. Interruption of the communication link with receiver RS then triggers the corresponding signalling at S, to indicate the touch.

In order to obtain cancellation of strokes taken on the respective weapons for the adverse weapon, we apply to each a low-frequency contact signal from local generator G. Generator G produces positive pulses of very short length which are directed toward the touching apparatus by the direct contact between the tip of the touching weapon and the shell of the weapon touched, and thanks to the antenna effect procured by the body of each fencer present. It should be noted in FIG. 3 that the pulses from G are coupled to the body of each fencer.

Cancellation of strokes on the metal ground P*i* is obtained in a similar way (according to FIGS. 1 and 2) by the interruption of similar pulses furnished by the ground generator GP (FIG. 2). Its electrical common point, which is connected with that of the receiving and signalling apparatus (or any other conductor), produces an antenna effect relative to the body of the fencer concerned, in the course of a touch on the ground.

The pulses received in either case are suitably shaped and slightly amplified by the buffer stage SE, at the output of which are produced positive pulses. These positive pulses are accpeted by the following stage P, which is sensitive to these kinds of signal, then integrated by capacitor C1 in order to obtain a continuous component. The latter is used to keep the transmitter in operation in spite of the blocking effect resulting from the action exerted by switch I and amplifier B, which manifests itself in both cases (strokes on weapon and weapon touching ground).

Since the electrical common point of each weapon, to which is applied the signal from the corresponding generator G, is common to the electrical common point M of the receiver, the local signal has no action at this point on the receiving system.

Furthermore, the axial conductors which terminate at the sensitive tip I, are normally lodged in the metal shell of the blade, its electrical common point, therefore being subject to the influence of the local generator G. But, if we refer to FIG. 4, we see that if a touch on any conductive surface, the latter prolongs, so to speak, the tip of the weapon by adding to it, thereby a receiving antenna capable of intercepting the G pulse signal transmitted by the body M*c* of the fencer touched. The body being in fact, connected to the signal output of the local generator G by the bracelet B*c*, serves as a transmitting antenna. We thus have coupling between the transmitting and receiving elements associated on the same apparatus at a common point M. As a result, the pulses thus collected are reversed relative to those picked up on the adverse shell.

We see then that in the case of a touch on the adverse weapon, we collect positive pulses which are passed by channel P. But in the case of a touch on any conductive area (mask, sweat-soaked clothing), considered invalid, the pulses reversed by the antenna type coupling cannot in this case pass channel P, which then delivers no compensating voltage. The valid touch can then be recorded.

The same is true if pulses from the electrical antenna effect of the body of the adversary are picked up by diffusion, at the time of a touch on a conductive area adjoining the body, or in contact with it (the case of a metal mask or sweat-soaked clothing). There again, since these unwanted pulses are reversed relative to the useful pulses from the weapon, they are not accepted by the discriminator stage P.

In the case of the foil (FIG. 5), the usual weapon contains only one axial conductor *a* and its tip switch I works by breaking a contact established continuously with the electrical common conductor of the weapon.

In the absence of a touch, the command voltage (beam B) designed to act on transmitter E is therefore eliminated by short-circuit of the B input to the electrical common through switch I. But when switch I is actuated in a non-conductive area, this voltage is made available to interrupt the transmission by means of amplifier B, which, on reception trips the corresponding signal.

The modifications necessitated by this new weapon are embodied by the system of wiring incorporated in the weapon, without having to modify the apparatus.

An apparatus that can be used for the two weapons can therefore be embodied by adding only the elements N and RC, these elements are designed to reveal the signals of particular shape collected in the event of a touch on the plastron.

The signal generator G, already used with the epee, is formed for this purpose by anassymmetric multivibrator furnishing both narrow positive pulses taken at the input to the multivibrator, and whose use for discrimination of the weapon has already been described, and sufficiently wide negative waveforms or pulses, taken at the output from the multivibrator and applied to the respective plastron T, where they are picked up by the tip of the weapon when a touch is made.

The resulting capacitative influence resulting from the antenna effect, due to the body of each fencer, is used by associating it with the input resistance of the buffer stage SE to form a differentiating circuit. The result then is a deformation of only the wide pulses, expressed by the appearance of a positive pulse associated with the original negative waveform. This is shown at the input X to the buffer stage SE on the right unit of FIG. 5.

At the output from the buffer stage, SE, the differentiated positive pulses, being similar at every point to those from the weapon, are sent toward the channel P corresponding to their polarity. The continuous component which results is used to keep the transmitter in service in spite of the action of the tip switch.

Moreover, the negative waveform cannot act on channel P, which does not pass this kind of signals, but on the contrary are collected by channel N provided to be responsive only to negative going signals. The waveforms produced at the output of N are used to modulate the transmitter E, either directly or by command of a modulator, in order thereby to transmit the corresponding information toward the remote signalling receiver RS.

If there is a touch on the adverse weapon, the narrow pulses, not being concerned by the differentiation effect, are transmitted directly without modification. The process is therefore the same as for the epee.

In the case of a touch on a non-excited conductive surface, the local pulses picked up by coupling between the body of the toucher and the tip of his weapon, undergo, as in the case of the epee, a reversal of polarity, to produce pulses which cannot be passed by channel P. These pulses, however, can accede to channel N, corresponding to their polarity. But since the channel concerned is equipped with a circuit with a circuit with a time constant network (in this case an integrator circuit RC), whose function is to absorb, or filter, the narrow pulses, the latter can have no effect on the transmitter.

In the event the plastron waveforms, coming from respective local generator G, were to appear reversed in the same manner, the differentiated signal would likewise give rise to negative pulses which would be treated as just described for channel N, and to positive waveforms which would be rejected by channel P, the latter being designed to pass only narrow pulses. We profit by the same process of reversal in the case of a touch on a conductive surface linked more less directly with the body of the adversary.

All the operations of discrimination are carried out by the individual pieces of apparatus, and the transmitter is therefore required to transmit only the useful information toward the remote signalling receiver, which has the function of actuating the display apparatus according to the following processes:

In the absence of a touch: continuous transmission of a non-modulated signal, from the transmitter E of each fencer, whose function is to keep the signalling idle and provide a check of proper operation.

On the occurrence of a normal touch in an inadmissible area: interruption of the continuous signal, expressed by the tripping of the corresponding signal.

For a touch on the plastron (in the case of the foil): transmission of a modulated signal. The modulation extracted on reception is designed to actuate a signal corresponding to this type of touch.

The arrangement presented in the description of the patent in the form of a composite diagram in FIGS. 3 and 5, is given esentially by the way of example to facilitate comprehension of the process involved. But it is quite clear that the same results can be obtained with the use of different dispositions.

We can, for example, separate the input to the current amplifier B or other system whose function is to block the remote signalling transmitter, and the input to the buffer stage SE, designed to intercept and dispatch the various signals, in order to make these two elements independent, since their working conditions are different. It is advantageous, for this purpose, to have the transmitter commanded by means of the buffer stage.

FIG. 6 shows a detailed representation of a buffer stage for an epee, according to which the command of a transmitter E is produced by means of the buffer stage which is inserted in the command circuit.

This buffer stage comprises a transistor T, held non-conductive by the presence of the single resistor R2. In this case, no voltage is available across the transmitter resistor R3. When a touch takes place and switch I is closed, the presence of a voltage from resistor R1, which is connected to the T voltage source, gives the transistor T the proper biasing voltage for it to work as a linear amplifier. A suitable voltage then appears across emitter resistor R3. This command voltage is used, in the arrangement already described, to block the remote signalling transmitter by means of the current amplifier B. The buffer stage, at the same time, is capable of dispatching the inhibiting pulses collected by contact of the tip on the adverse weapon. These pulses appear reversed on the collector of T1, which receives voltage from resistor R4, and are applied to channel P in FIG. 3 which is considered in this case to pass only negative pulses.

In the case of application to the foil, it is sufficient to connect the resistors R1 and R2 to the axial conductor at the input X of the buffer, connect the plastron to point C, and allow for reversal of polarity by channel N in FIG. 5.

What is claimed is:

1. Apparaus for scoring fencing bouts in which each fencer carries a weapon having first and second electrically conductive parts, said weapon comprising for each fencer a unit including:

means for transmitting a signal of a predetermined frequency, means for generating pulses for application to a first electrically conductive part of the respective weapon carried by a fencer, receiver means having an input for connection to a second electrically conductive portion of the respective weapon carried by a respective fencer, switch means on the weapon, means connected between said switch means and said transmitting means and responsive to a touch made by the weapon on the body of the other fencer to produce a command signal to operate the transmitting means of the unit of the fencer making a touch to produce a signal indicating the touch, said receiver means of the unit of the fencer making the touch also including means responsive to reception of pulses from the unit of the other fencer on the weapon associated with said receiving means for blocking the command signal from affecting the transmitting means of said unit.

2. Apparatus as in claim 1 wherein each said unit includes means for inhibiting the pulses from the pulse generator of the respective unit returned by coupling from the body of the other fencer from affecting the operation of the transmitting means of the unit originally producing the pulses.

3. Apparatus as in claim 1 wherein the electrical common point of the pulse generator means of a unit is connected to the electrical point of the weapon with which it is associated which is also the electrical common point of the receiving means.

4. Apparatus as in claim 1 wherein the pulses produced by a respective generator means are of a frequency lower than that of the corresponding transmitting means.

5. Apparatus as in claim 4 wherein the pulses are of short duration and have a predetermined polarity.

6. Apparatus as in claim 1 wherein said receiving means includes a first signal channel havng buffer circuit means with substantially linear amplification characteristics, and means for passing signals of only one polarity connected to said buffer circuit means.

7. Apparatus as in claim 6 wherein the command signal producing means applies a signal to said transmitting means when the switch is actuated by a touch.

8. Apparatus as in claim 6 wherein the weapon includes a first electrical conductor connected to the input of said buffer stage means, a second electrical conductor connected to said command signal producing means, said switch means connected between said first and second conductors adapted to be closed when a touch is made by the weapon for applying the command signal to said transmitting means to produce an output thereon.

9. Apparatus as in claim 8 wherein said weapon is an epee and said first and second conductors extend axially of its blade.

10. Apparatus as in claim 6 further comprising an integrating means connected to the pulse passing means of the first channel.

11. Apparatus as in claim 6 wherein there is a second channel including means for passing only signals having a polarity different from those passed by the pulse passing means of the first channel, and means for applying the pulses passed by the second channel to modulate the transmitting means.

12. Apparatus as in claim 11 wherein the pulse passing means of the first and second channels both derive signals from the output of the buffer stage means, each channel having means for passing signals only of a predetermined length and polarity.

13. Apparatus as in claim 1 further comprising means for coupling the pulses from a respective pulse generator to the body of the fencer carrying the unit, the pulses from the pulse generator means of one unit being communicated to the receiving means of the other unit by direct contact of the weapon associated with the one unit with the body of the fencer carrying the other unit and by coupling caused by the conductivity of the body of each fencer.

14. Apparatus as in claim 13 wherein the pulses coupled to the receiver associated with the fencer carrying said other unit are reversed in polarity from the pulses produced by the pulse generator means included in said other unit.

15. Apparatus as in claim 1 further comprising a directional antenna means coupled to the transmitting means for radiating the signal produced thereby, and loop antenna means defining the area for the fencing match for receiving the signals radiated by said directional antenna means.

16. Apparatus as in claim 15 wherein said loop antenna means is of low impedance.

17. Apparatus as in claim 1 further comprising an electrically conductive ground means and means for supplying pulses at a low frequency to said ground means.

18. Apparatus as in claim 17 wherein said means for supplying pulses to said conductive ground means has a high impedance output.

19. Apparatus as in claim 1 wherein the weapon includes a first electrical conductor, connected between the switch means and the command signal producing means, said switch means carried by said weapon operating to apply the command signal to said transmitting means when a touch is made on the body of the other fencer.

20. Apparatus as in claim 19 wherein said weapon is a foil and said first electrical conductor means extends axially of the foil, said switch means being normally closed and connected to disable the command signal means when closed.

21. Apparatus as in claim 1 wherein an electrically conductive plastron is provided for each fencer, said pulse generator producing pulses of two polarities, the pulses of one polarity being applied to the first electrically conductive part point of the weapon and the pulses of the other polarity being applied to the plastron.

22. Apparatus as in claim 21 wherein the pulses of said one polarity are of a short duration as compared to the pulses of the other polarity.

23. An improved apparatus for scoring fencing abouts between a plurality of fencers each carrying a weapon having at least one electrically conductive part, said apparatus including, for each fencer, a unit including a transmitter actuable to operate in an active mode wherein a predetermined signal is produced to indicate a touch by the corresponding fencer and in an inactive mode wherein said indicating signal is not produced, and means positioned on the corresponding weapon for sensing when said weapon makes a touch, the improvement comprising, for each unit:

means connected to a first conductive part of said weapon and to the body of the corresponding fencer for generating pulses of a predetermined shape, polarity and duration; and a receiver having an input coupled to said sensing means and an output coupled to said transmitting means and being constructed and arranged to normally maintain said transmitter in a first of said active and inactive modes, said receiver including:
means responsive to the sensing of a touch by said sensing means for actuating said transmitter to the other of said active and inactive modes, and
means reponsive only to a pulse at the input of said receiver having a predefined shape, polarity and duration for disabling said actuating means.

24. The apparatus of claim 23 wherein said predefined shape, polarity and duration correspond to said predetermined shape, polarity and duration, said disabling means receiving pulses of said predefined shape, polarity and duration when the corresponding weapon makes a touch on the first conductive portion of an opponent's weapon and when pulses from said generator are coupled back to said receiver during a touch on a conductive surface, so that said actuating means is disabled.

25. The apparatus of claim 24 wherein pulses provided to the body of an opponent are coupled to said disabling means with inverted polarity when said weapon makes a touch on a conductive surface adjacent to the opponent's body, ssaid coupled pulses having no effect on said disabling means, so that said actuating means actuates said transmitter.

26. The apparatus of claim 23 further comprising an electrically conductive ground means and means for supplying pulses of said predetermined shape, polarity and duration to said ground means.

27. An apparatus as in claim 23 wherein an electrically conductive plastron is provided for each fencer, said generating means providing pulses having portions of opposite polarity, the portion of one polarity being applied to said first electrically conductive part of the weapon and the portion of the other polarity being applied to said plastron.

28. The apparatus of claim 27 wherein the pulse portion of said one polarity is of substantially shorter duration than the pulse portion of the other polarity.

29. Apparatus as in claim 23 wherein said disabling means includes a first signal channel having a buffer circuit with a substantially linear amplification characteristic, and means for passing pulses of only one polarity connected to said buffer curcuit means.

30. Apparatus as in claim 29 further comprising an integrating means connected to said pulse passing means.

31. Apparatus in accordance with claim 29 further comprising a second channel including means for passing only signals having a polarity different from those passed by the pulse passing means of said first channel, and means for applying pulses passed by said second channel to modulate said transmitting means.

32. Apparatus as in claim 29 further comprising directional antenna means coupled to said transmitting means for radiating said indicating signal, and loop antenna means defining the area for said fencing bout for receiving said radiated signal.

* * * * *